US010062558B2

(12) United States Patent
Yasuno

(10) Patent No.: US 10,062,558 B2
(45) Date of Patent: Aug. 28, 2018

(54) MASS SPECTROMETER

(75) Inventor: Motohide Yasuno, Kyoto (JP)

(73) Assignee: Shimadzu Co., Kyoto (JP)

( * ) Notice: Subject to any disclaimer, the term of this patent is extended or adjusted under 35 U.S.C. 154(b) by 576 days.

(21) Appl. No.: 13/013,668

(22) Filed: Jan. 25, 2011

(65) Prior Publication Data

US 2011/0186732 A1 Aug. 4, 2011

(30) Foreign Application Priority Data

Jan. 29, 2010 (JP) ..... 2010-018326

(51) Int. Cl.
*H01J 49/10* (2006.01)

(52) U.S. Cl.
CPC ..... *H01J 49/10* (2013.01)

(58) Field of Classification Search
CPC ..... H01J 49/02; H01J 49/04; H01J 49/0404; H01J 49/0422; H01J 49/06; H01J 49/062; H01J 49/065; H01J 49/066
USPC ..... 250/288, 290, 292, 293, 281, 282
See application file for complete search history.

(56) References Cited

U.S. PATENT DOCUMENTS 6,107,628 A * 8/2000 Smith ..... H01J 49/066 250/292
6,583,408 B2 * 6/2003 Smith et al. ..... 250/288
6,803,565 B2 10/2004 Smith et al. ..... 250/288
7,495,212 B2 * 2/2009 Kim et al. ..... 250/292
2004/0159782 A1 * 8/2004 Park ..... H01J 49/40 250/282
2009/0039283 A1 * 2/2009 Franzen et al. ..... 250/425
2009/0302209 A1 * 12/2009 Green et al. ..... 250/282

FOREIGN PATENT DOCUMENTS

JP 2008-192519 8/2008
WO WO 97/49111 12/1997

* cited by examiner

*Primary Examiner* — David E Smith

(57) ABSTRACT

A technique for improving the efficiency of injecting ions into the electrode unit of a funnel structure having high ion-transport efficiency is provided to improve the overall ion-transport efficiency. From an ionization chamber 1 for ionizing a sample under atmospheric pressure, ions are injected through a straight capillary pipe 3 into the inner space of the electrode unit 10 of a funnel structure composed of ring electrodes in a first intermediate vacuum chamber 4. The space for setting the capillary pipe 3 is formed by replacing one or more ring electrodes with C-shaped electrodes whose circumference portion is partially removed. Each C-shaped electrode is arranged so that the ions will be injected perpendicularly to the ion-transport direction. The injected ions lose energy due to collision cooling, become converged onto the ion-beam axis C due to the ion-confining effect of a radio-frequency electric field, and efficiently move toward the exit aperture along a potential gradient created by a direct-current electric field. The gas stream carrying the ions passes through the gaps of the ring electrodes, without increasing the gas pressure at the exit of the ring-electrode inner space and thereby deteriorating the degree of vacuum in the next stage.

11 Claims, 4 Drawing Sheets

MASS SPECTROMETER

The present invention relates to a mass spectrometer, and more specifically to a mass spectrometer suitable for an atmospheric pressure ionization mass spectrometer in which a sample is ionized under approximately atmospheric pressure and subjected to mass analysis.

BACKGROUND OF THE INVENTION

An atmospheric pressure ionization mass spectrometer, which uses an ion source for ionizing ions under approximately atmospheric pressure by an appropriate ionization method, such as electrospray ionization (ESI), atmospheric chemical ionization (ACPI), inductively coupled plasma ionization (ICP) or atmospheric pressure matrix laser assisted ionization (AP-MALDI), generally includes a multi-stage differential pumping system to maintain a high-vacuum atmosphere within a vacuum chamber in which a mass analyzer (e.g. a quadrupole mass filter or a time of flight mass spectrometer) is provided. In this type of mass spectrometer, it is necessary to efficiently transport ions under a low-vacuum atmosphere with a gas pressure of approximately 1-$10^4$ Pa. For this purpose, various types of ion transport optical systems (which may also be referred to as ion guides or ion lenses) with different forms and configurations have been proposed and supplied for practical uses.

In some cases, the term "ion transport optical system" is used to refer only to an electrode unit for creating an electric field within a space which the ions pass through. However, the resulting electric field not only depends on the configuration of the electrode unit; it is also affected by the voltages applied to the electrodes. Accordingly, the term "ion transport optical system" is hereinafter used to refer to a system that includes both the electrode unit and a voltage-applying unit (circuit) for applying voltages to the electrodes.

One conventionally known type of ion transport optical systems is the so-called "ion funnel", which is disclosed in WO97/49111 and other documents. As shown in FIG. 9, the electrode structure of the ion funnel basically consists of an array of ring electrodes arranged at equal intervals along the ion-transport direction, with each electrode having a circular aperture at the center thereof through which ions can pass. Not all of these electrodes have the same aperture diameter; their aperture diameter gradually decreases in the ion-transport direction, with the electrode at the ion-entrance end having the largest aperture diameter and the electrode at the ion-exit end having the smallest aperture diameter. A pair of radio-frequency voltages having a phase difference of 180 degrees (that is, with reverse phases) are applied to any pair of ring electrodes neighboring each other in the ion-transport direction. As a result, a radio-frequency electric field for confining ions is created in the inner space of the ring-electrode array (this space is called the "ring-electrode inner space" in this specification). Additionally, a direct-current (DC) voltage is applied from the voltage-applying unit to each of the electrodes to create a potential gradient that promotes the travel of ions in the ion-transport direction.

The ring-electrode inner space is in the form of a funnel that is tapered in the ion-transport direction. Therefore, the radio-frequency electric field created in this space has a relatively strong spatial-focusing effect for converging ions into the vicinity of the central axis (ion-beam axis) of the ring electrodes. In the case where the ion funnel is used under a low-vacuum atmosphere of approximately $10^2$-$10^4$ Pa, a focusing effect due to collisional cooling also works on the ions since there is a considerable amount of residual gas. Due to these effects, the ion beam has an extremely small beam diameter when it is emitted from the ring electrode at the exit end of the ion-transport direction, and the emitted ions have low emittance. Another advantage exists in that the ions can be efficiently transported since the radio-frequency electric field is evenly formed in the circumferential direction around the central axis and thereby suppresses the leakage of ions through the spaces between the neighboring electrodes, which occurs in the case of a multi-pole rod configuration.

Examples of atmospheric pressure ionization mass spectrometers using the previously described type of ion funnels are disclosed in U.S. Pat. Nos. 6,107,628, 6,803,565 and 6,583,408. In these mass spectrometers, the electrode unit of the ion funnel is disposed in a low-vacuum chamber next to the ionization chamber in which electrospray ionization is performed. The ions produced in the ionization chamber are sent through a capillary pipe into the low-vacuum chamber, where the ions are injected along the ion-transport direction into the circular aperture of the ring electrode located at the front end, and a thin beam of ions is emitted from the ring electrode located at the farthest end.

As just described, the ion funnel has outstanding ion-transport efficiency and ion-converging capability. However, this device has the following problems.

In a mass microscope (which may also be called an imaging mass spectrometer) using AP-MALDI as disclosed in Harada et al. "Kenbi shitsuryou Bunseki Souchi Ni Yoru Seitai Soshiki Bunseki (Analysis of Living Tissue Using Mass Microscope", *Shimadzu Hyouron* (*Shimadzu Review*), Shimadzu Hyouron Henshuu-bu, Vol. 64. No. 3/4, Apr. 24, 2008, the sample to be analyzed is placed on a horizontal plane within a sample chamber maintained at approximately atmospheric pressure for the convenience of microscopic observation of the sample with an optical microscope. Therefore, the ions produced from the sample by laser irradiation need to be extracted upwards. On the other hand, an ion-transport optical system (RE ion guide), an ion trap and a time-of-flight mass analyzer are horizontally arranged in the vacuum chamber, where ions are transported in the substantially horizontal direction. Accordingly, the capillary pipe, which functions as an interface connecting the sample chamber and the vacuum chamber, has its entrance directed downwards and its exit directed horizontally. This design is realized by almost perpendicularly bending the capillary pipe at the middle point thereof. Such a design also applies to the case where an ion funnel is used as the ion-transport optical system, in which case the ions are almost horizontally ejected from the exit of the bent capillary pipe and injected into the apertures of the ring electrodes.

There is a pressure difference between the entrance and exit ends of the capillary pipe. This pressure difference produces a gas stream, which carries ions into the capillary pipe, transports them to the exit end, and ejects them into the vacuum chamber. However, if the capillary pipe is significantly bent in the previously describe manner, the gas stream is disturbed at the bent portion, making the ions collide with the inner wall of the pipe and possibly causing a considerable loss of ions. This problem is particularly serious since the inner diameter of the capillary pipe is small to restrict conductance for several reasons, e.g. to maintain the low gas pressure inside the vacuum chamber or to allow the use of a low-power pump as the pump for evacuating the vacuum chamber. Using such a thin capillary pipe increases the influence of the disturbance of the gas stream and results in a considerable ion loss. Thus, even if the ion funnel can efficiently transport ions, the overall ion-transport efficiency cannot be easily improved since a significant amount of ions is lost in the previous stage.

The ions ejected from the exit of the capillary pipe are introduced through the aperture of the ring electrodes into the ring-electrode inner space together with the gas stream. In the ion funnel, the ring electrodes are arrayed at small intervals, so that the gas hardly diffuses through the gap between the neighboring ring electrodes. Therefore, a significant part of the gas flows through the ring-electrode inner space, to be ejected from the small aperture of the ring electrode located at the exit end. As a result, the gas pressure around the exit of the ion funnel becomes higher than the surrounding pressure, which deteriorates the degree of vacuum atmosphere in the subsequent stage where the ion-transport optical system and the mass analyzer are provided. To solve this problem, a mass spectrometer is disclosed in U.S. Pat. No. 6,583,408, in which a disk-shaped electrode is provided on the ion-beam axis within the ring-electrode inner space so that the gas stream will collide with this electrode and become deflected outwards. However, adding this electrode makes the electrode structure more complex. Furthermore, the additional electrode is likely to become contaminated and disorder the electric field in the ring-electrode array.

On the other hand, in a mass spectrometer using an ICP ion source as disclosed in Japanese Unexamined Patent Application Publication No. 2008-192519, an off-axis ion-transport optical system is used to remove elements that will cause a background noise, such as the light or neutral particles emitted from the ion source. In the case of the ion funnel, the off-axis structure can be created, for example, by gradually shifting the axis of each ring electrode. However, this method may possibly disorder the radio-frequency or DC electric field and thereby considerably deteriorate the ion-transport efficiency.

The present invention has been developed to solve the previously described problems, and one objective thereof is to provide a mass spectrometer in which a high level of analysis sensitivity is achieved by improving the overall ion-transport efficiency while making use of the advantages of the ion funnel. Another objective of the present invention is to provide a mass spectrometer which is designed to suppress the gas pressure around the rear end of the ring-electrode array having a funnel structure while making use of the advantages of the ion funnel. Still another objective of the present invention is to provide a mass spectrometer which is designed to obtain the effect of the off-axis structure while making use of the advantages of the ion funnel.

SUMMARY OF THE INVENTION

The present invention aimed at solving the previously described problems is a mass spectrometer in which an ion produced in an ion source at a first gas pressure is transported to a mass-analyzing unit disposed under a vacuum atmosphere at a second gas pressure lower than the first gas pressure, and the mass spectrometer includes:

a) an ion-transport optical system including an electrode unit and a voltage-applying unit, the electrode unit being disposed under a vacuum atmosphere at a gas pressure lower than the first gas pressure and higher than the second gas pressure and having a funnel structure composed of a plurality of ring electrodes arrayed in an ion-transport direction, the ring electrodes having apertures whose diameter gradually decreases at least within a partial section along the ion-transport direction, the voltage-applying unit applying radio-frequency voltages with reverse phases to each pair of the ring electrodes neighboring each other in the ion-transport direction and also applying a direct-current voltage to each of the ring electrodes to create a potential gradient for making the ion travel in the ion-transport direction; and b) an ion-injecting unit for injecting the ion into a ring-electrode inner space surrounded by the plurality of ring electrodes of the electrode unit, the ion being injected in a direction substantially perpendicular to the ion-transport direction and at a point farther than the ring electrode located at the nearest end in the ion-transport direction.

The mass-analyzing unit may include, for example, a mass analyzer (e.g. a quadrupole mass filter, time-of-flight mass analyzer or three-dimensional quadrupole ion trap) and an ion detector. The mass-analyzing unit is disposed under a high-vacuum atmosphere. The second gas pressure is normally within a range from $10^{-3}$ to $10^{-5}$ Pa. On the other hand, the first gas pressure may be set to be approximately equal to or higher than atmospheric pressure. This setting is preferable in that an atmospheric pressure ion source, such as ESI, APCI, AP-MALDI or ICP, can be used as the ion source.

In the mass spectrometer according to the present invention, although the electrode unit of the ion-transport optical system has a funnel structure, ions are not injected along the ion-transport direction into the aperture of the ring electrode located at the nearest end in the ion-transport direction, but injected laterally from one side of the electrode unit into the ring-electrode inner space in a direction substantially perpendicular to the ion-transport direction. The direction of injection of the ions does not coincide with the ion-transport direction. However, after being injected into the ring-electrode inner space, the ions follow curved paths, converging on the central axis of the ring electrodes (i.e. the ion-beam axis). This is because of the effect of the radio-frequency electric field created within the ring-electrode inner space and also the cooling effect due to the collision with the residual gas. Meanwhile, the ions also travel in the ion-transport direction due to the effect of the direct-current electric field, which is mainly created within the ring-electrode inner space. Although the ions are initially injected in the direction substantially perpendicular to the ion-transport direction, they can be assuredly transported toward the ring electrode located at the exit end, while being spatially converged, without colliding with the opposite wall surfaces of the ring electrodes since a pseudo-potential barrier is created in the vicinity of the inner circumferential edges of the ring electrodes by the radio-frequency electric field. Thus, while laterally injecting the ions, the high transport efficiency of the ion funnel can be fully utilized.

The gas that is injected from the ion-injecting unit into the ring-electrode inner space together with the ions collides with the wall surfaces of the ring electrodes, and most of the gas passes through the gaps between the neighboring ring electrodes to the outside of the electrode unit. Accordingly, unlike the case where the ions are injected through the aperture of the ring electrode in the ion-transport direction, no extreme increase in the gas pressure occurs at the small-sized aperture of the ring electrode located at the exit end. Therefore, the degree of vacuum of the atmosphere in the subsequent stages, where the ion-transport optical system, the mass analyzer and other devices are disposed, is prevented from being deteriorated. The light, neutral particles and other elements coming through the ion-injecting unit into the ring-electrode inner space together with the ions are not affected by the electric field and hence directly collide with the wall surfaces of the ring electrodes or pass through to the outside of the electrode unit. Thus, the same effect as the off-axis configuration can be obtained.

In one mode of mass spectrometer according to the present invention, the ion-injecting unit is a thin pipe having an exit end located inside the ring-electrode inner space and an entrance end located at a point where the ion produced by the ion source can be collected, and a direct-current voltage for repelling the ion is applied to at least the exit end of the thin pipe.

By this configuration, the ions can be assuredly (i.e. efficiently) injected through the thin pipe into the ring-electrode inner space. In the present case, the thin pipe may be provided through the gap of the neighboring ring electrodes. However, since the ring electrodes are normally arranged at considerably small intervals, it is often difficult to find any room for passing the thin pipe between the ring electrodes. Accordingly, in one preferable mode of the present invention, at least one of the ring electrodes is substantially "C-shaped" by removing a section thereof, and the thin pipe is placed in the space created by removing the aforementioned section. The presence of this C-shaped ring electrode causes a disorder of the resulting electric field. However, the influence of this disorder of the electric field on the behavior of the ions is slight since the ions injected through the thin pipe immediately fly away from the removed section of the ring electrode.

To collect ions produced by the ion source as efficiently as possible and send them into the ring-electrode inner space, it is preferable to increase the inner diameter of the thin pipe (the cross-sectional area of the channel) or provide a plurality of thin pipes. Furthermore, to prevent ions from colliding with the inner wall of the thin pipe and thereby being annihilated while passing through the thin pipe, it is preferable to use the shortest possible pipe having no bent portion. That is to say, the thin pipe should preferably have a straight shape extending from the entrance end to the exit end.

The thin pipe, which is designed to transport ions from the ion source to the ring-electrode inner space, can also function as a desolvation pipe for vaporizing solvent from ion-containing droplets or charged droplets. Accordingly, in one preferable mode of the mass spectrometer according to the present invention, the ion source is either an electrospray ionization source, an atmospheric pressure chemical ionization source, or an atmospheric pressure photo-ionization source, and the thin pipe is a desolvation pipe that can be heated.

In another mode of the present invention, a predetermined number of ring electrodes among the aforementioned plurality of ring electrodes are each substantially "C-shaped" by removing a section thereof, the ion-injecting unit is an electrode having an orifice for sampling ions provided in the space formed by the removed sections of the predetermined number of ring electrodes, and a direct-current voltage for repelling the ions is given to the electrode having the orifice. In this case, it is also possible to increase the aperture area of the orifice or provide a plurality of orifices to increase the amount of ions to be injected.

In the mass spectrometer according to the present invention, no ion is injected through the aperture of the ion-ring electrode into the ring-electrode inner space. Therefore, it is possible to configure the electrode unit so that a disk-shaped electrode with no aperture is provided before the ring electrode located at the nearest end in the ion-transport direction among the plurality of ring electrodes and a direct-current voltage for repelling ions is given to the disk-shaped electrode.

By this configuration, even if an ion injected into the ring-electrode inner space moves in the direction opposite to the ion-transport direction, for example, by being carried by the gas stream, the ion will be repelled due to the effect of the electric field created by the disk-shaped electrode and begin to move in the ion-transport direction. As a result, the ion-transport efficiency will be further improved.

As stated earlier, the collision cooling effect must also be fully used to properly converge the ions injected laterally into the ring-electrode inner space. For this purpose, the gas pressure in the ring-electrode inner space should preferably be within a range from $10^2$ to $10^4$ Pa.

In the mass spectrometer according to the present invention, ions are laterally injected into the ring-electrode inner space of the electrode unit having a funnel structure composed a plurality of ring electrodes. The injected ions can be efficiently transported to the subsequent stages by using the converging effects of the radio-frequency electric field and the collision cooling as well as the conveying effect of the direct-current electric field. Therefore, even though the direction in which ions are collected within the ion source and the ion-transport direction of the ion-transport optical system do not coincide with each other but are substantially perpendicular to each other, the ions collected from the ion source can be directly injected, for example, through a thin straight pipe into the ring-electrode inner space of the ion-transport optical system. The ions can be more efficiently collected in the ion source and more efficiently conveyed to the ring-electrode inner space than in the conventional cases. As a result, a larger amount of ions will be supplied to the mass-analyzing unit on a total basis, so that the analysis sensitivity will be improved. Another advantage exists in that the ion source and the electrode unit of the ion-transport optical system can be more freely arranged than in the conventional cases, which facilitates the device design aimed at special purposes, such as reducing the device size.

Furthermore, the increase in the gas pressure around the exit end, which occurs in the case of the conventional ion funnel, can be avoided without providing an additional electrode or similar element on the ion-beam axis. This reduces the load on the pump used for creating a required degree of vacuum in the vacuum chamber in the subsequent stage. Therefore, for example, an inexpensive vacuum pump that is inferior in performance to conventionally used ones can be used. The combination of the funnel structure and the off-axis configuration makes it possible to remove the influence of neutral particles and light undesirable for the analysis and thereby reduce the noise or the cause of performance degradation due to contaminations by solvent of a sample e.g. charge up.

DETAILED DESCRIPTION OF PREFERRED EMBODIMENTS

First Embodiment

One embodiment (first embodiment) of the mass spectrometer according to the present invention is hereinafter described with reference to the attached drawings.

Figure 1:
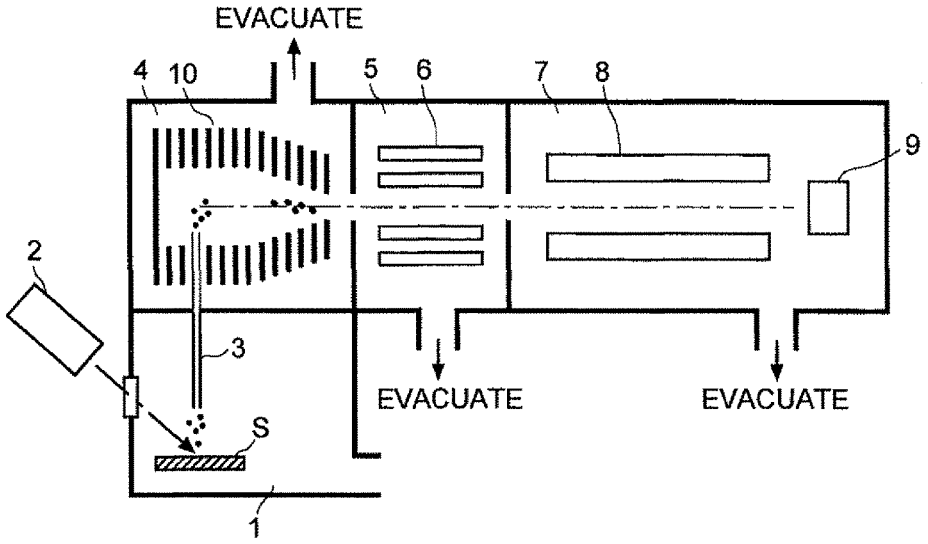
FIG. 1 is a schematic configuration diagram of an AP-MALDI mass spectrometer as one embodiment (first embodiment) of the present invention.
Figure 2:
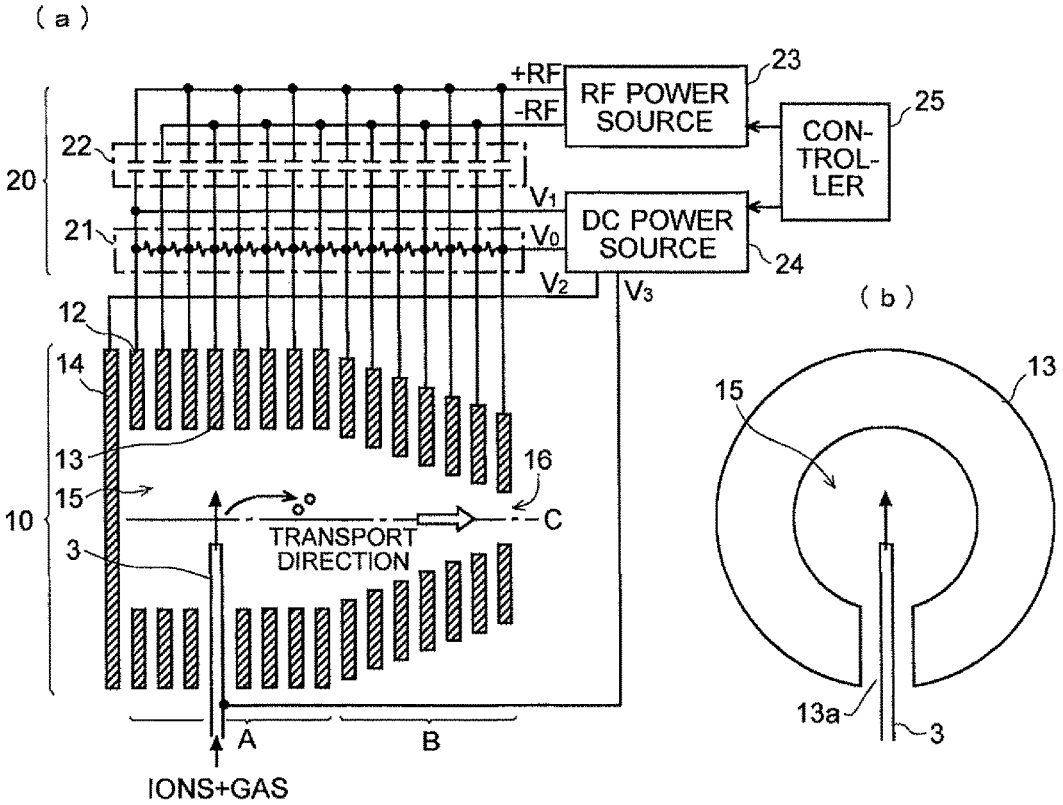
FIG. 2 is a configuration diagram of the ion-transport optical system in the mass spectrometer of the first embodiment.

FIG. 1 is a schematic configuration diagram of an AP-MALDI mass spectrometer according to the first embodiment, and FIG. 2 is a configuration diagram of the ion-transport optical system in this mass spectrometer.

The present mass spectrometer has the configuration of a multi-stage differential pumping system including an ionization chamber 1 at approximately atmospheric pressure, a high vacuum chamber 7 evacuated with a high-performance vacuum pump (turbo molecular pump, which is not shown), and two intermediate vacuum chambers 4 and 5 provided between the aforementioned chambers 1 and 7. In the ionization chamber 1, a sample S containing a sample component to be analyzed is irradiated with a laser beam from a laser source 2, whereby the sample component is ionized. The first intermediate vacuum chamber 4 contains an electrode unit 10 having a characteristic funnel structure as part of the ion-transport optical system. The second intermediate vacuum chamber 5 contains an ion guide 6 composed of multipole (e.g. octapole) rod electrodes. The high vacuum chamber 7 contains a quadrupole mass filter 8 as the mass analyzer and an ion detector 9. The gas pressures in the high vacuum chamber 7, second intermediate vacuum chamber 5 and first intermediate vacuum chamber 4 are maintained within ranges of $10^{-3}$ to $10^{-5}$ Pa, $10^{-1}$ to $10^{-2}$ Pa and $10^{1}$ to $10^{4}$ Pa, respectively.

The ionization chamber 1 and the first intermediate vacuum chamber 4 communicate with each other through a straight capillary pipe 3, which corresponds to the thin pipe of the present invention. Its entrance end is located directly above the sample S, while its exit end is inside the electrode unit 10. Since there is a pressure difference between the entrance and exit ends of the capillary pipe 3, the air inside the ionization chamber 3 flows through the capillary pipe 3 into the first intermediate vacuum chamber 4. The ions generated from the sample S upon irradiation with the laser beam are mostly released upwards and drawn into the capillary pipe 3, to be conveyed into the first intermediate vacuum chamber 4 by the gas flow.

FIG. 2(*a*) shows an end face of the electrode unit 10 of the ion-transport optical system cut at a plane including the ion-beam axis C, and FIG. 2(*b*) is an end face of a ring electrode 13 (having a removed section) shown in FIG. 2(*a*) cut at a plane orthogonal to the ion-beam axis C. FIG. 2(*a*) also illustrates the circuit unit 20 other than the electrode unit 10. The electrode unit 10 is composed of a plurality of ring electrodes 12 arrayed at equal intervals in the ion-transport direction. These ring electrodes 12 are designed to form a funnel structure; the ring electrodes belonging to group A have the same aperture diameter while the aperture diameter of the ring electrodes belonging to group B gradually decreases along the ion-transport direction. A disk-shaped electrode 14 having no aperture, whose outer diameter is equal to that of the ring electrode 12 located at the nearest end in the ion-transport direction, is provided before this ring electrode 12. The fourth ring electrode 13 counted from the nearest one in the ion-transport direction is not a complete ring; as shown in FIG. 2(*b*), it is substantially "C-shaped" on a plane perpendicular to the ion-transport direction and has a removed section 13*a*. This ring electrode 13 is set so that the removed section 13*a* directly faces the wall separating the first intermediate vacuum chamber 4 and the ionization chamber 1. The capillary pipe 3 is disposed in the space formed by this removed section 13*a*.

This structure is adopted since the interval of the neighboring ring electrodes needs to be rather small and hence it is normally difficult to ensure an adequate space through which the capillary pipe 3 can pass. If an adequate space for passing the capillary pipe 3 exists between the neighboring ring electrodes 12, it is unnecessary to provide the aforementioned C-shaped special ring electrode 13. Conversely, it is also possible to sequentially arrange two or more C-shaped ring electrodes in the ion-transport direction so as to provide a large space for passing the capillary pipe 3.

As already stated, under the control of a controller 25, two radio-frequency voltages having a phase difference of 180 degrees and the same amplitude are applied from a radio-frequency voltage power source 23, via a capacitor 22, to the ring electrodes 12 and 13 arrayed along the ion-beam axis C. Specifically, one radio-frequency voltage (+RF) is applied to every other ring electrode 12 or 13, and the other radio-frequency voltage (−RF) is applied to each ring electrode 12 or 13 neighboring one of the ring electrodes 12 or 13 to which +RF is applied. For group 13, in which the aperture diameter of the ring electrodes gradually decreases, the amplitude of the applied radio-frequency voltage may be reduced with the decrease in the aperture diameter, whereby the ion-transport efficiency can be further improved. Furthermore, a direct-current voltage $V_1$ is applied from a direct-current voltage power source 24 to the ring electrode 12 located at the nearest end in the ion-transport direction, and a direct-current voltage $V_0$ is applied to the ring electrode 12 at the exit end. Direct-current voltages whose level changes stepwise from $V_1$ to $V_0$ are also applied via the resistor array 21 to the other ring electrodes 12 and 13 located in between. Furthermore, a direct-current voltage $V_2$ is applied from the direct-current power source 24 to the disk-shaped electrode 14 to create an electric field for repelling ions near this electrode 14. For the same purpose, a direct-current voltage $V_3$ is applied to the capillary pipe 3.

For example, when the analysis target is a positive ion, $V_1$ may be set at 100 V and $V_0$ at 0 V (the ground potential) to create a potential gradient that falls stepwise in the ion-optical direction. In this case, both $V_2$ and $V_3$ may be the same as $V_1$, i.e. 100 V. The voltage setting is not limited to these values and can be appropriately changed. The polarity of these voltages should naturally be reversed when the analysis target is a negative ion.

By applying the voltages in the previously described manner, a radio-frequency electric field that confines ions in the funnel-shaped space (the ring-electrode inner space) surrounded by the ring electrodes 12 and 13. Additionally, a direct-current electric field for conveying the ions in the ion-transport direction is created and superposed on the radio-frequency electric field. As noted previously, the C-shaped ring electrode 13 causes a disorder of the electric field since it has the removed section 13*a*. However, this disorder scarcely influences the motion of ions since the ions are ejected from the capillary pipe 3 in the direction away from the removed section 13*a*.

As explained earlier, the ions generated from the sample S upon laser irradiation within the ionization chamber 1 are transferred through the capillary pipe 3 into the first intermediate vacuum chamber 4 and released from the exit end of the capillary pipe 3 into the ring-electrode inner space in the direction substantially perpendicular to the ion-beam axis C. Since the capillary pipe 3 is a straight pipe having no bent portion, the probability that the ions drawn from the space above the sample S into the capillary pipe 3 will collide with the inner wall of the pipe or other parts is relatively low, so that a high percentage of the ions can pass through the capillary pipe 3. The gas stream ejected from the exit end of the capillary pipe 3 flows almost directly and collides with the ring electrodes 12 and 13, and most of the gas exits through the gaps between the neighboring ring electrodes 12 and 13 to the outside. Therefore, unlike the conventional ion funnel, the present system causes no unfavorable increase in the gas pressure around the exit aperture 16 of the ring-electrode inner space. Furthermore, neutral particles and other non-charged particles being conveyed from the ionization chamber 1 with the ions are non-sensitive to the electric field and hence travel almost directly, to be ejected from the ring-electrode inner space.

As described previously, the ions are injected in a direction that differs from the ion-transport direction. However, most of these ions will be confined in the ring-electrode inner space due to the effect of the radio-frequency electric field. The residual gas existing in a relatively large quantity within the first intermediate vacuum chamber 4 collides with the injected ions and cools them, thus facilitating the capturing of ions by the electric field. A relatively high potential barrier is created in the vicinity of the inner edges of the apertures of the ring electrodes 12 and 13, and the ions, which have low levels of kinetic energy after the collision cooling, cannot climb over this barrier and will be pushed back toward the ion-beam axis C. Thus, even though the ions are initially injected in a direction that differs from the ion-transport direction, only a small loss of ions will occur. Furthermore, a potential gradient for conveying ions from the disk-shaped electrode 14 along the ion-transport direction is created. Therefore, the ions captured by the radio-frequency electric field move in the ion-transport direction, i.e. toward the exit aperture 16, along the potential gradient.

Some of the ions may be carried by a gas stream or the like in a direction opposite to the ion-transport direction. However, as the ions approach the disk-shaped electrode 14, they experience a strong repelling force and change their direction to the ion-transport direction to eventually head for the exit aperture 16. Thus, although the ions were initially injected into the ring-electrode inner space in the direction substantially perpendicular to the ion-optical direction, the ions can be efficiently transported toward the exit aperture 16. As the ions approach the exit aperture 16, the aperture diameter decreases, making the ion converge on the ion-beam axis C to be eventually emitted in the form of an ion beam having a small diameter (e.g. 1 mm or even smaller), which can be efficiently sent into the second intermediate vacuum chamber 5 in the next stage.

Figure 6:
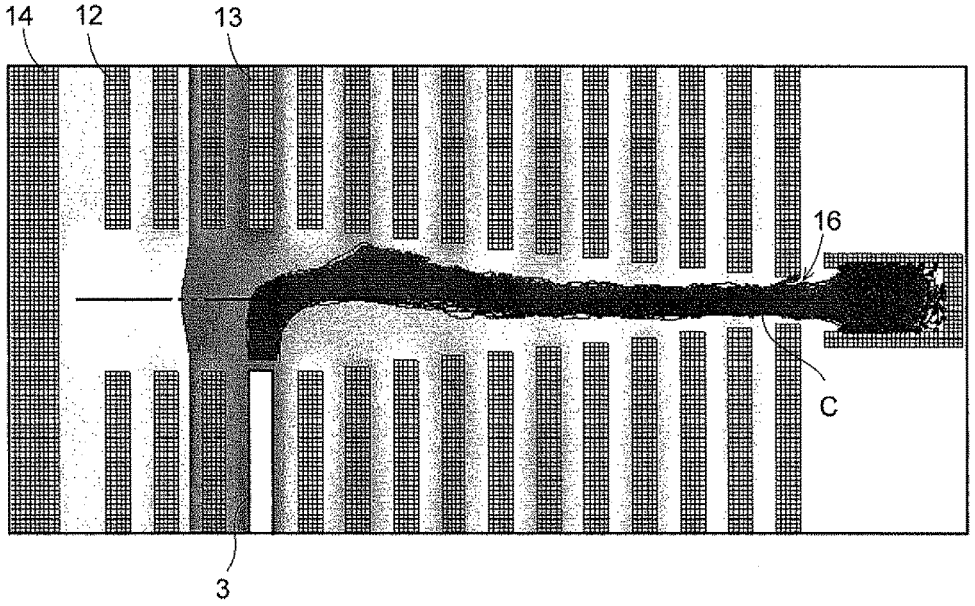
FIG. 6 is an illustration showing the result of simulation of the trajectories of ions in the ion-transport optical system of the first embodiment.

The present inventor has conducted a computer simulation of the ion trajectories in an ion-transport optical system having basically the same configuration as the previous embodiment to confirm that ions will behave in the previously described manner in the ion-transport optical system of the mass spectrometer according to the present embodiment. The result is hereinafter described by means of FIG. 6. The simulation assumed the following conditions: the mass-to-charge ratio (m/z) of the ions, 1000; the initial kinetic energy of the ions (the kinetic energy at the moment when the ions are released into the ring-electrode inner space), 100 eV; the amplitude of the radio-frequency voltage applied to the electrode unit 10, 60 Vp-p; the frequency of the same radio-frequency voltage, 1.0 MHz; $V_2=V_1=100$ V; $V_0=0$ V; and the aperture diameters of the ring electrodes, from 3 mm (maximum) to 1 mm (minimum). FIG. 6 clearly shows that the ions injected into the ring-electrode inner space are transported toward the exit aperture 16 while being adequately converged.

Given that the velocity of the gas flowing through the capillary pipe 3 into the ring-electrode inner space is $2.5\times10^3$ m/s and the upper limit of the mass-to-charge ratio of the ions to be analyzed is 1000, the highest possible kinetic energy of the ions carried by the gas stream is approximately 30 eV. Even in the case of an ion with a mass-to-charge ratio of 2000, the kinetic energy of the ion being carried by the gas stream is approximately 65 eV.

The aforementioned gas-flow velocity, $2.5\times10^3$ m/s, is a normal value for a gas flowing into an interface composed of a sampling cone and a skimmer, which is a ion-transport system typically used for connecting a space at atmospheric pressure and a space in a low-vacuum state, in which the gas flows from a space at atmospheric pressure into a space of approximately 100 Pa formed between the sampling cone and the skimmer (this space corresponds to the first intermediate vacuum chamber 4). The velocity of the gas ejected from the thin capillary pipe 3 connecting the ionization chamber 1 (which is at atmospheric pressure) and the first intermediate vacuum chamber 4 in the configuration of the previous embodiment can also be estimated to be approximately equal to the aforementioned value, and the upper limit of the velocity of the ions injected into the inner space of the ring electrodes 12 and 13 with the gas stream ejected from the capillary pipe 3 should also be at approximately that value. Accordingly, the value of kinetic energy assumed in the previous ion-trajectory simulation, 100 eV (m/z=1000), is probably a rather overestimated value for an ion to be injected from a space at atmospheric pressure into the ring-electrode inner space under actual conditions. The computer simulation has demonstrated that the ions can be efficiently transported even under such strict conditions. Therefore, it is reasonable to estimate that the ion-transport system characteristic of the present invention will also exhibit outstanding ion-transport capability under actual conditions.

Figure 3:
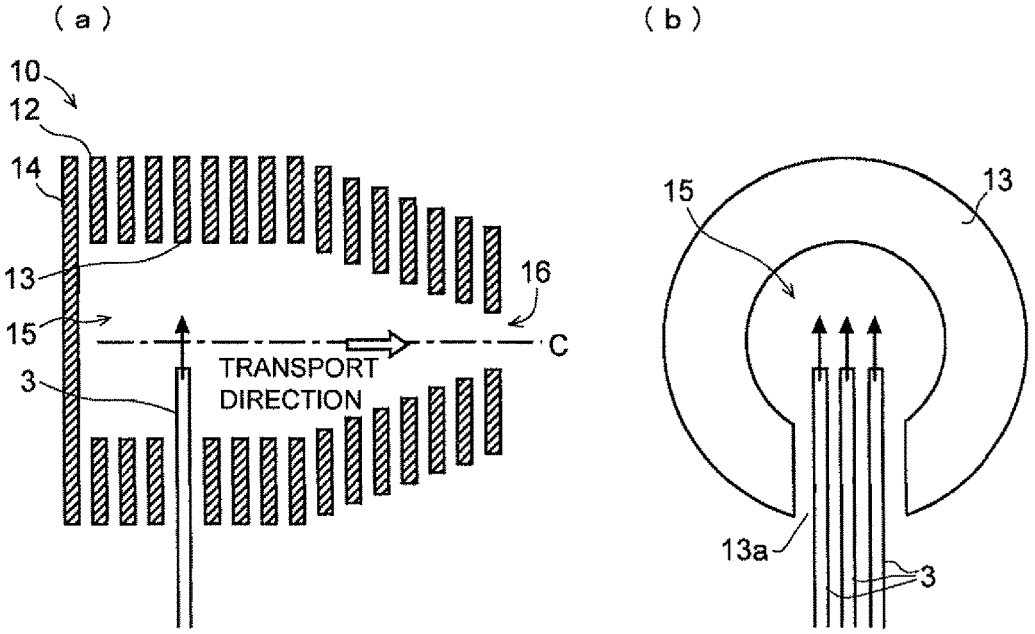
FIG. 3 is a configuration diagram of the ion-transport optical system in one variation of the first embodiment.

The inner diameter of the capillary pipe 3 is normally from 0.5 mm to a few mm, and the supply rate of ions from the ionization chamber 1 to the first intermediate vacuum chamber 4 depends on the conductance of this capillary pipe 3. Accordingly, if it is necessary to increase the amount of ions injected into the electrode unit 10, the conductance of the capillary pipe 3 can be increased. This can be achieved, for example, by increasing the inner diameter of the capillary pipe 3 or decreasing its length. It is also possible to provide a plurality of capillary pipes 3 having the same inner diameter (or even different inner diameters), as in FIG. 3, which shows an example of using three pipes. However, it should be noted that increasing the conductance of the capillary pipe 3 beyond a certain level needs a more powerful vacuum pump in order to attain the required degree of vacuum in the first intermediate vacuum chamber 4.

Figure 4:
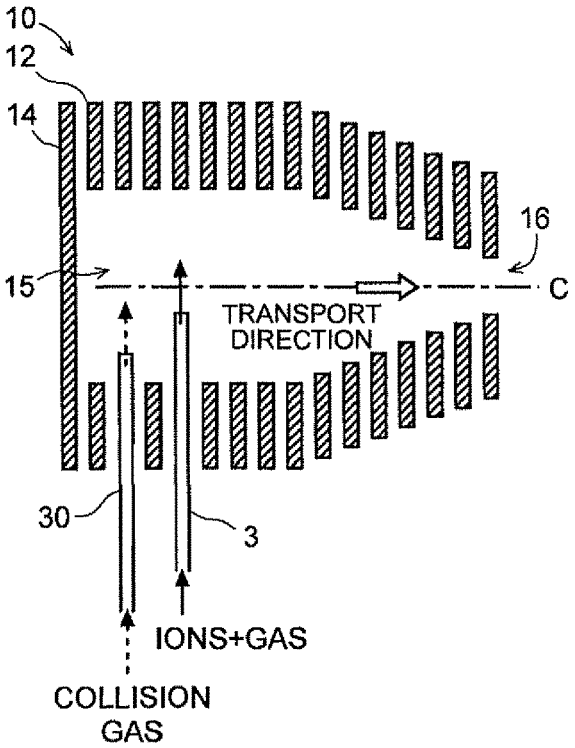
FIG. 4 is a configuration diagram of the ion-transport optical system in another variation of the first embodiment.

Furthermore, as shown in FIG. 4, a gas injection pipe 30 may be provided in addition to the capillary 3, and a gas intended for some special effect may be intentionally injected through the gas injection pipe 30 into the first intermediate vacuum chamber 4 to perform some operations on the ions within the ring-electrode inner space by means of the effect of the gas. For example, a collision gas, such as $N_2$, Ar or Xe, may be introduced to cause collision-induced dissociation within the ring-electrode inner space and perform a mass analysis of the fragment ions. Alternatively, a noble gas (e.g. He or Ar), metastable gas consisting of $N_2$ gas in a long-lived excited state, or similar gas may be injected for the post-ionization of sample molecules that have been injected into the ring-electrode inner space without being ionized in the ionization chamber 1.

A quadrupole mass filter or other mass analyzers having rather low mass resolution cannot separately detect two molecules (or atoms) whose difference in mass-to-charge ratio ink is smaller than the mass resolution, even if they have different compositions. In such a situation, it is difficult to correctly analyze the target ion since the non-target ion interferes with the target ion. A non-target ion having such a relationship to a target ion (signal ion) is called an interfering ion. If a mass analyzer with high mass resolution is used, such as a time-of-flight mass analyzer or sector-type mass analyzer, the interfering ion can be separated from the signal ion. However, if a quadrupole mass filter or similar mass analyzer is used for some reason, it is necessary to devise a method for removing the interfering ion. One conventionally developed method for removing an interfering ion includes the process of making the interfering ion react with $HN_3$, $O_2$, $H_2$ or another reactant gas to transform it into an ion having a different composition or a neutral gas. In another conventional method, helium gas, which acts as the collision gas, is made to collide with the ions, causing each ion to lose its energy by an amount determined by its collision cross-section, and the ions are separated according to their kinetic energy after the collision process. Such a reactant gas or collision gas can also be introduced into the first intermediate vacuum chamber 4 in the configuration of the previous embodiment (and any other configuration which will be described later) to remove interfering ions within the ring-electrode inner space and thereby prevent the interfering ions from entering the low-mass resolution mass analyzer, such as the quadrupole mass filter.

Figure 5:
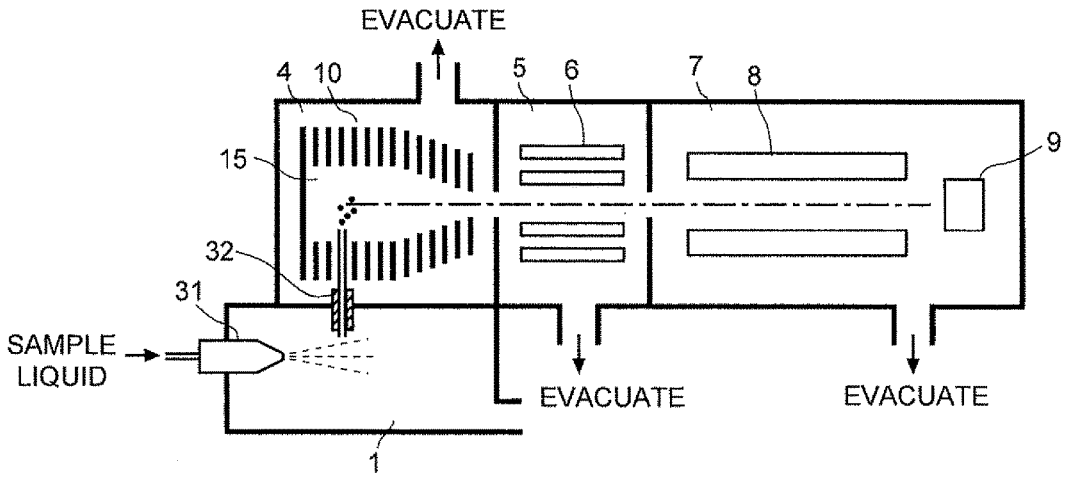
FIG. 5 is a schematic configuration diagram of an ESI mass spectrometer using the ion-transport optical system of the first embodiment.

In the mass spectrometer of the first embodiment, an atmospheric pressure MALDI was used as the ion source. This can be easily changed to a configuration using a different type of atmospheric pressure ion source. FIG. 5 shows an example in which an ESI ion source is used. In this case, a sample liquid supplied to an ESI spray unit 31 is turned into fine charged droplets and sprayed into the ionization chamber 1 at approximately atmospheric pressure. The charged droplets repeatedly collide with the surrounding air or the like, turning into even smaller droplets, while producing ions. These ions are drawn into the straight desolvation pipe 32 with the fine droplets. The desolvation pipe 32 is heated to vaporize the solvent in the droplets flowing inside, whereby the ionization further proceeds. The ions conveyed by the gas stream are ejected from the exit end of the desolvation pipe 32 into the ring-electrode inner space and, as described previously, transported toward the exit aperture 16. The herein described process is also basically common to the case where an APCI or APPI is used as the ion source.

In FIGS. 1-5, the ion-beam axis C in the electrode unit 10 of the funnel structure and the central axis of the capillary pipe 3 are perpendicular to each other. It is evident that they do not need to be perfectly perpendicular to each other. The previously described effects can be obtained even if the angle is slightly different from the right angle as long as it can be virtually regarded as the right angle.

Second Embodiment

Another embodiment (second embodiment) of the mass spectrometer according to the present invention is hereinafter described with reference to the attached drawings.

Figure 7:
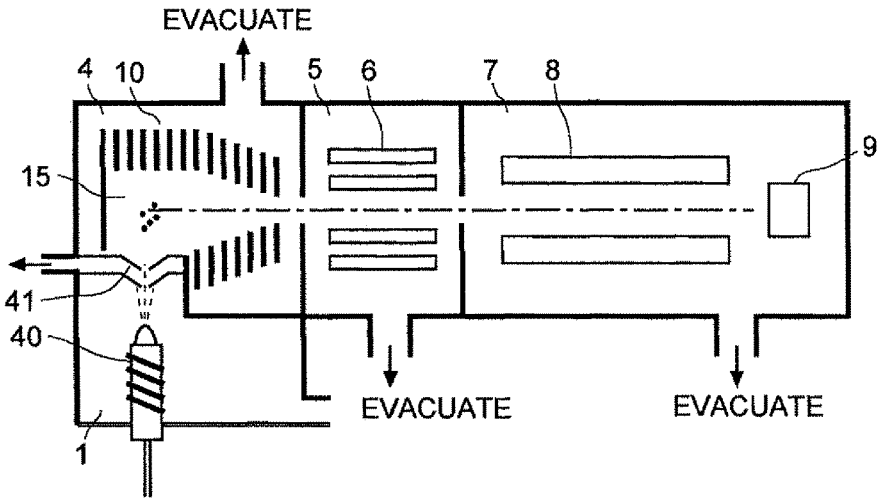
FIG. 7 is a schematic configuration diagram of an ICP mass spectrometer as the second embodiment of the present invention.
Figure 8:
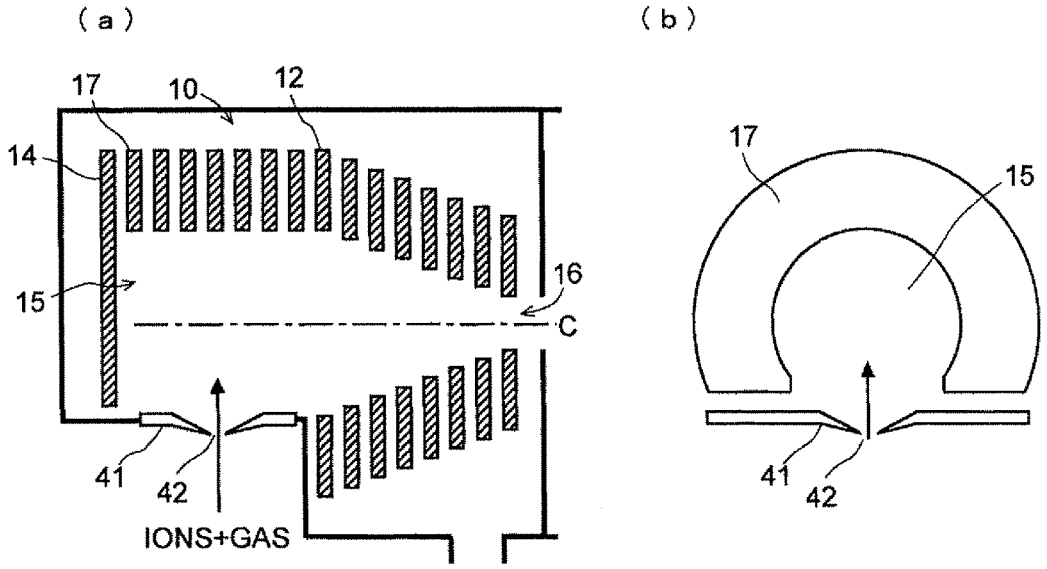
FIG. 8 is a configuration diagram of the ion-transport optical system in the mass spectrometer of the second embodiment.
Figure 9:
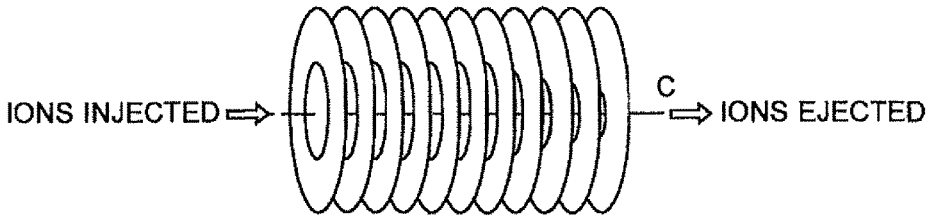
FIG. 9 is a schematic perspective view of the electrode unit of a commonly used ion funnel.

FIG. 7 is a schematic configuration diagram of an ICP mass spectrometer according to the second embodiment, and FIG. 8 is a configuration diagram of the ion-transport system in the present mass spectrometer. The same components as used in the mass spectrometer and the ion-transport optical system of the first embodiment are denoted by the same numerals, and detailed descriptions of such components will be omitted.

In the present mass spectrometer, a sampling cone 41 is provided between the ionization chamber 1 and the first intermediate vacuum chamber 4. A micro-sized orifice 42 is bored at the top of the sampling cone 41, through which ions can be injected into the ring-electrode inner space of the electrode unit 10. For this purpose, a number of ring electrodes 17 located in the nearer half of the electrode unit 10 in the ion-transport direction are "C-shaped" having a removed section covering approximately two-fifths of the entire circumference. These electrodes 17 are not "ring" shaped in a strict sense but called "ring electrodes" for convenience. The other components are the same as those of the first embodiment.

In this ICP mass spectrometer, ions are generated in a plasma flame produced by a plasma torch 40, which is the ion source. The generated ions are injected through the orifice 42 of the sampling cone 41 into the ring-electrode inner space of the first intermediate vacuum chamber 4. Similar to the first embodiment, the injecting direction of the ions is substantially perpendicular to the ion-transport direction. The light and neutral particles originating from the plasma flame directly pass through and hence will not enter the second intermediate vacuum chamber 5. On the other hand, the ions undergo the effects of the radio-frequency electric field and the direct-current electric field as well as the collision cooling effect, so that they will be efficiently converged into a thin beam and emitted from the exit aperture 16. Thus, this mass spectrometer can also supply a larger amount of ions for mass analysis and thereby achieve a high level of analysis sensitivity.

It should be noted that ICP mass spectrometers are normally used to analyze elemental ions ranging from $Li^+$ to $U^+$, whose mass-to-charge ratios m/z are rather low, i.e. approximately within a range from 7 to 238. It is generally known that such elemental ions cannot be efficiently transported in the farther portion of the ion funnel where the aperture diameters of the ring electrodes gradually decrease, because the ion funnel has the property of a low mass cut-off. Accordingly, when the present invention is applied to an ICP mass spectrometer and high ion-transport efficiency must be ensured for elemental ions or similar ions having low mass-to-charge ratios, it is desirable to take into account the trade-off between the ion-transport efficiency and the ion-converging capability (or the gas pressure of the vacuum chamber in the subsequent stage) when determining the aperture diameters of the electrode unit of the funnel structure.

Similar to the first embodiment, the mass spectrometer of the second embodiment may also be provided with a plurality of orifices 42 to increase the conductance so that a larger amount of ions will be injected.

It should be noted that each of the previous embodiments is a mere example of the present invention, and any change, modification or addition appropriately made within the spirit of the present invention will be naturally included within the scope of claims of the present patent application.

What is claimed is:

1. A mass spectrometer comprising:

a first chamber in which an ion of a sample component is produced by an ion source, the first chamber held at a first gas pressure;

a second chamber containing a mass-analyzing unit to which the ion is transported, the second chamber held at a second gas pressure lower than the first gas pressure;

an ion-transport optical system including an electrode unit and a voltage-applying unit, the electrode unit being disposed in a third chamber under a vacuum atmosphere at a gas pressure lower than the first gas pressure and higher than the second gas pressure, the third chamber being placed between the first chamber and the second chamber, the electrode unit having a funnel structure composed of a plurality of ring electrodes arrayed in an ion-transport direction, the ring electrodes having apertures whose diameter gradually decreases at least within a partial section along the ion-transport direction, the voltage-applying unit applying radio-frequency voltages with reverse phases to each pair of the ring electrodes neighboring each other in the ion-transport direction and also applying a direct-current voltage to each of the ring electrodes to create a potential gradient for making the ion travel in the ion-transport direction; and an ion-injecting unit for injecting the ion of the sample component into a ring-electrode inner space surrounded by the plurality of ring electrodes of the electrode unit, the ion being injected in a direction substantially perpendicular to the ion-transport direction and at a point farther than the ring electrode located at a nearest end in the ion-transport direction, wherein the ion-injecting unit includes a thin pipe passing through a gap between neighboring ring electrodes and having an exit end located inside the ring-electrode inner space and an entrance end located at a point where the ion produced by the ion source can be collected.

2. The mass spectrometer according to claim 1, wherein a direct-current voltage for repelling the ion is applied to at least the exit end of the thin pipe.

3. The mass spectrometer according to claim 1, comprising a plurality of the thin pipes.

4. The mass spectrometer according to claim 1, wherein at least one of the ring electrodes is substantially C-shaped by removing a section thereof, and the thin pipe is placed in a space created by removing the aforementioned section.

5. The mass spectrometer according to claim 1, wherein the thin pipe is a straight shape extending from the entrance end to the exit end.

6. The mass spectrometer according to claim 1, wherein: the ion source is either an electrospray ionization source, an atmospheric pressure chemical ionization source, or an atmospheric pressure photo-ionization source; and the thin pipe is a desolvation pipe that can be heated.

7. The mass spectrometer according to claim 1, wherein: a predetermined number of ring electrodes among the aforementioned plurality of ring electrodes are each substantially "C-shaped" by removing a section thereof; the ion-injecting unit is an electrode having an orifice for sampling ions provided in the space formed by the removed sections of the predetermined number of ring electrodes; and a direct-current voltage for repelling the ions is given to the electrode having the orifice.

8. The mass spectrometer according to claim 7, comprising a plurality of the aforementioned orifices.

9. The mass spectrometer according to claim 1, wherein the electrode unit is configured so that a disk-shaped electrode with no aperture is provided before the ring electrode located at the nearest end in the ion-transport direction among the plurality of ring electrodes and a direct-current voltage for repelling ions is given to the disk-shaped electrode.

10. The mass spectrometer according to claim 1, wherein a gas pressure inside the ring-electrode inner space is within a range from $10^2$ to $10^4$ Pa.

11. The mass spectrometer according to claim 1, wherein the first gas pressure is approximately equal to or higher than atmospheric pressure.

* * * * *